US005928170A

United States Patent [19]

Garrigan

[11] Patent Number: 5,928,170

[45] Date of Patent: Jul. 27, 1999

[54] AUDIO-ENHANCED SEXUAL VIBRATOR

[76] Inventor: Russell Garrigan, 310 S. Dixie Hwy, #3, West Palm Beach, Fla. 33401-5838

[21] Appl. No.: 09/001,126

[22] Filed: Dec. 30, 1997

[51] Int. Cl.[6] ..... A61H 1/00

[52] U.S. Cl. ..... 601/47

[58] Field of Search ..... 601/45, 46, 47, 601/78–84; 607/115, 138; 600/38; 128/883, 884

[56] References Cited

U.S. PATENT DOCUMENTS

| | | | |
|---|---|---|---|
| Re. 35,082 | 11/1995 | Kuo . | |
| 1,703,642 | 1/1929 | Sticht . | |
| 3,669,100 | 6/1972 | Csanad . | |
| 4,055,170 | 10/1977 | Nohmura . | |
| 4,296,376 | 10/1981 | Bartol, Jr. . | |
| 4,722,326 | 2/1988 | Ruderian . | |
| 4,722,327 | 2/1988 | Harvey . | |
| 5,067,480 | 11/1991 | Woog et al. | 601/70 X |
| 5,076,261 | 12/1991 | Black . | |
| 5,163,447 | 11/1992 | Lyons . | |
| 5,165,131 | 11/1992 | Staar . | |
| 5,283,970 | 2/1994 | Aigner . | |
| 5,377,692 | 1/1995 | Pfeil . | |
| 5,438,726 | 8/1995 | Leite . | |
| 5,460,597 | 10/1995 | Hopper . | |
| 5,468,172 | 11/1995 | Basile . | |
| 5,524,638 | 6/1996 | Lyons . | |
| 5,573,499 | 11/1996 | McCallister | 601/70 |
| 5,690,603 | 11/1997 | Kain | 600/38 |
| 5,769,090 | 6/1998 | Brown | 128/883 |
| 5,782,779 | 7/1998 | Kilgore | 601/70 |

*Primary Examiner*—Linda C. M. Dvorak
*Assistant Examiner*—Justine Yu
*Attorney, Agent, or Firm*—Quarles & Brady

[57] ABSTRACT

A hand-held sexual vibrator including a vibrating mechanism and an audio signal processor for recording and playing back personalized messages, before or after sexual interplay, for enhanced aural stimulation. The audio signal processor is enclosed within the housing of the vibrator.

9 Claims, 4 Drawing Sheets

AUDIO-ENHANCED SEXUAL VIBRATOR

FIELD OF THE INVENTION

The present invention relates to electrical hand-held massaging devices, and more particularly to a hand-held electric or battery operated vibrators used primarily for sexual stimulation.

BACKGROUND OF THE INVENTION

A variety of vibrators have been described, many of which are commercially available, and many of which have been the subject of patents. For example, a vibratory therapy device comprising a lightweight portable housing encasing a heater/vibrator assembly for imparting vibratory action to a massaging head, together with heated airflow, is described in U.S. Pat. No. 4,722,326. The device includes a plurality of interchangeable massage heads having different surface textures or configurations.

U.S. Pat. No. 4,722,327 describes a massaging device comprising an elongated generally cylindrical artificial penis which is moved reciprocally by a motor disposed in a separate housing in order to provide sexual stimulation or gratification to the user. A similar device is described in U.S. Pat. No. 5,076,261, but which provides movement of a simulated phallus in both a horizontal and vertical direction.

An electric vibrating or massaging device having a plurality of detachable attachments for use in marital orgasmic therapy is also provided in U.S. Pat. No. 5,067,480. This device includes a stimulator which rotationally oscillates through a range of angles for stimulation of appropriate body areas in marital or sexual orgasmic therapy.

Despite the various shapes, vibrating or oscillating mechanisms, and power supply designs which have been created to provide the user of such devices the benefits of massage therapy, these devices have the disadvantage of being limited to providing only stimulation through the sense of touch. The devices of the above-described patents lack any capacity to provide aural stimulation by use of sound or voices which can enhance the stimulation effect in sexual or orgasmic therapy.

Certain sexual devices have been described which provide a sound-playing element which plays a pre-recorded melody or message during sexual intercourse or contact. For example, U.S. Pat. No. 5,163,447 describes a condom which comprises a miniature force-sensitive sound playing unit attached to the proximal end of the condom. The sound playing unit contains a chip-controlled piezoelectric sound transducer which is activated by contact during intercourse.

A sound or light emitting device which is activated by contact during sexual intercourse is described in U.S. Pat. No. 5,524,638. This device comprises a ring portion and a contiguous housing in which a circuit is disposed which includes a sensory unit, such as a sound transducer or light emitting diode, a power supply source, and an activator. However, these sound emitting devices are limited to pre-recorded melodies or voice messages, primarily intended for amusement purposes. These pre-recorded audio signals may be impersonal, which can detract from providing appropriate aural stimulation during sexual or orgasmic therapy. These previously described devices do not provide for recording of personalized or individualized messages or melodies, or the transmittal of same. Recording of spontaneous thoughts or ideas that occur or are intended to be transmitted during sexual interplay is not available by use of a vibrator or other sexual device which plays only pre-recorded sounds.

Thus, it would be desirable to provide a vibrator which is useful for sexual stimulation and orgasmic therapy wherein the device includes a recording and playback function for recording and playing back personalized messages or sound effects which can be used for aural stimulation during intercourse or other sexual interplay, alone or with a partner.

BRIEF SUMMARY OF THE INVENTION

The subject invention concerns, in a preferred embodiment, an electrical, hand-held massaging device, commonly referred to as a "vibrator," preferably used for sexual stimulation or orgasmic therapy. The vibrator of the subject invention is advantageously equipped with solid-state audio recording and playback functions for recording and playing back customized or personalized messages or sounds wherein said recording elements are disposed within the hollow elongated housing of the vibrator. The subject device further comprises a vibrating element; a microphone wherein said microphone is in communication with the solid-state audio recorder; a separate speaker for transmitting the recorded sound; and control means for operating the recording element, playback function, and vibrating element. Advantageously, each of the elements is integrated into the device to provide a convenient, hand-held vibrator having readily accessible recording and playback features.

It is an object of the invention to enhance the pleasure or satisfaction of a person during sexual intercourse, sexual stimulation, or orgasmic therapy by providing a vibrating device which can record intimate or personalized messages, music, or other sound effects and selectively play back those messages, music, or sounds during intercourse, or sexual or orgasmic massage therapy. For example, thoughts or ideas may be recorded during sex for later use, or can be recorded in anticipation of playback during later sexual interplay.

It is another object of the invention to provide a vibrator having a re-useable recording element for recording personalized messages or sounds that can be particularly adapted or customized to a specific situation or directed to a particular individual or type of person.

A further object of the invention is to provide a vibrator which has tension-reducing capability separate from physical vibrating stimulation, e.g., a vibrator which is capable of reducing tension by aural stimulation.

It is yet another object of the invention to provide a vibrator which can produce comic relief for reducing anxiety or inhibitions in a sexual situation.

Another object of the invention is to provide a vibrator which can alter the mood of a person.

Yet a further object of the invention is to provide a vibrator that can capture spontaneous thoughts or ideas occurring during a sexual situation, whereby those thoughts or ideas may otherwise be lost or forgotten if not recorded during the emotional or passionate state of sexual arousal.

It is another object of the invention to provide a vibrating or massaging device comprising both a recording means for recording and playback of personalized messages, music, or other sound effects, and a means for playback of pre-recorded messages, music, or other sound effects.

These and other embodiments or variations of the subject invention will become apparent to persons of ordinary skill in the art in view of the description and accompanying drawings provided herein.

DETAILED DESCRIPTION OF THE INVENTION

The subject invention concerns a hand-held vibrating device commonly termed a "vibrator", used for sexual stimulation or orgasmic therapy, wherein the vibrator comprises an audio system for recording and playing back personalized messages, music, or other sound effects. The audio system comprises a microphone for receiving sound and converting that sound into an audio signal; an audio processor for receiving, storing or recording the audio signal, manipulating the audio signal, and playing back the audio signal by transmitting the signal to a sound transmitter; and a sound transmitter, e.g. a speaker, for transmitting the audio signal as audible sound.

Figure 1:
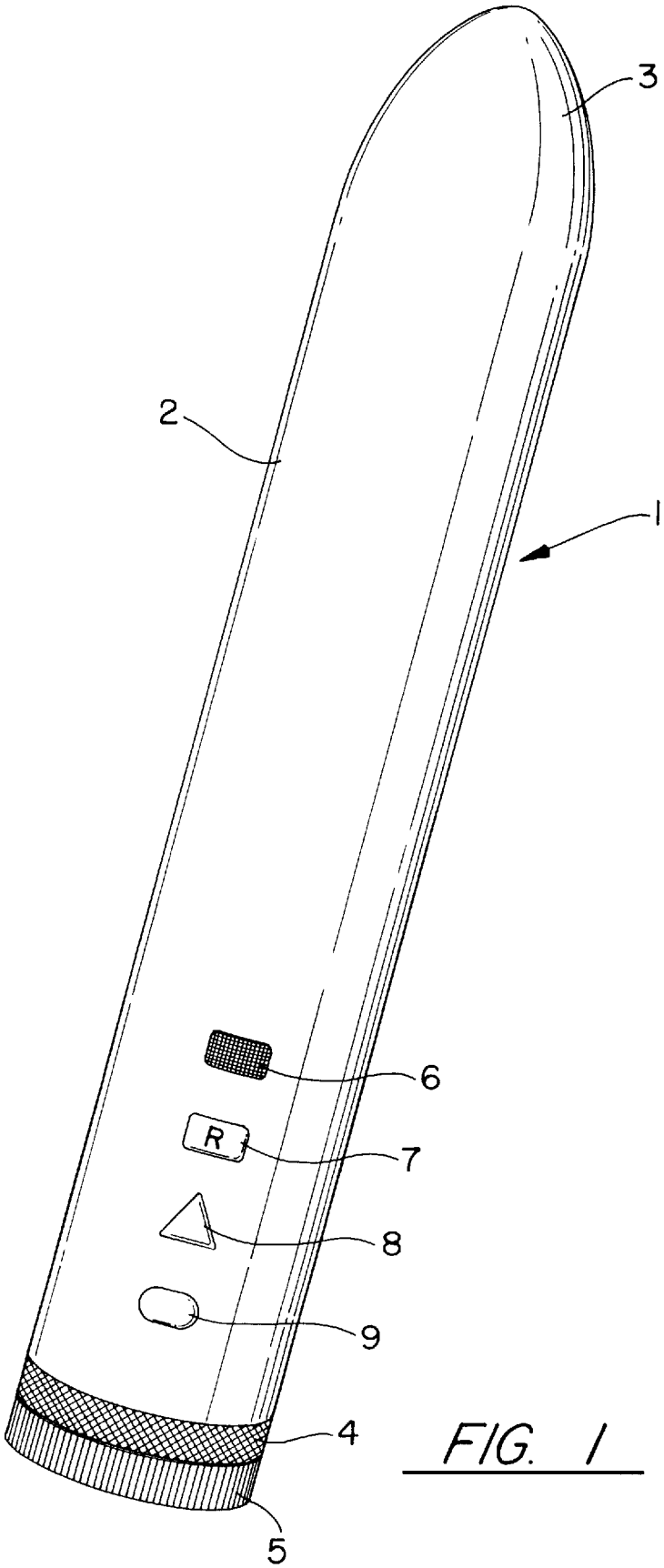
FIG. 1 illustrates a side view of one embodiment of the invention showing a microphone for recording of personalized messages and controls for recording, playing, or erasing those messages, and a capped end to provide access for a power source.

In reference to FIG. 1, an embodiment of vibrator 1 is shown as an elongated, substantially cylindrical housing 2, which is preferably hollow to contain the recording and playback system, as well as a power source and vibrating element. This integration of the audio system, vibratory element, and power source can provide the advantage of a portable, hand-held vibrator which is convenient to use.

The housing 2 can be formed from any semi-rigid or rigid material suitable for contact with skin. Typically, such devices are made from plastic or gel foam, having a texture which is pleasing to the touch. The outside of the housing 2 can be shaped like a human penis for enhanced visual stimulation. Preferably, the housing 2 is generally phallus shaped, having a first end 3 substantially rounded or tapered for facilitating insertion into a body cavity or orifice.

A second end 4 of the device preferably includes a detachable cap 5 for accessing an opening into a cavity formed by the hollow housing 2. The cap 5 is preferably threadably engaged to the second end 4 of the housing 2 and can be attached or integral with a control dial, e.g. a rheostat, for controlling the rate or speed of the vibrating mechanism or a volume control.

Disposed in a side wall of the housing 2, preferably toward the second end 4 of said housing 2, is a microphone 6 for receiving sound input for recording. Control buttons 7, 8, and 9 are preferably disposed along the shaft of the housing 2 for respectively operating recording, playback, and erasing functions of an internally disposed audio signal processor. The microphone 6 and control buttons 7, 8, and 9 are shown in convenient, aligned configuration, but other configurations could be used according to aesthetic preferences of a designer, manufacturer, or consumer.

Figure 2:
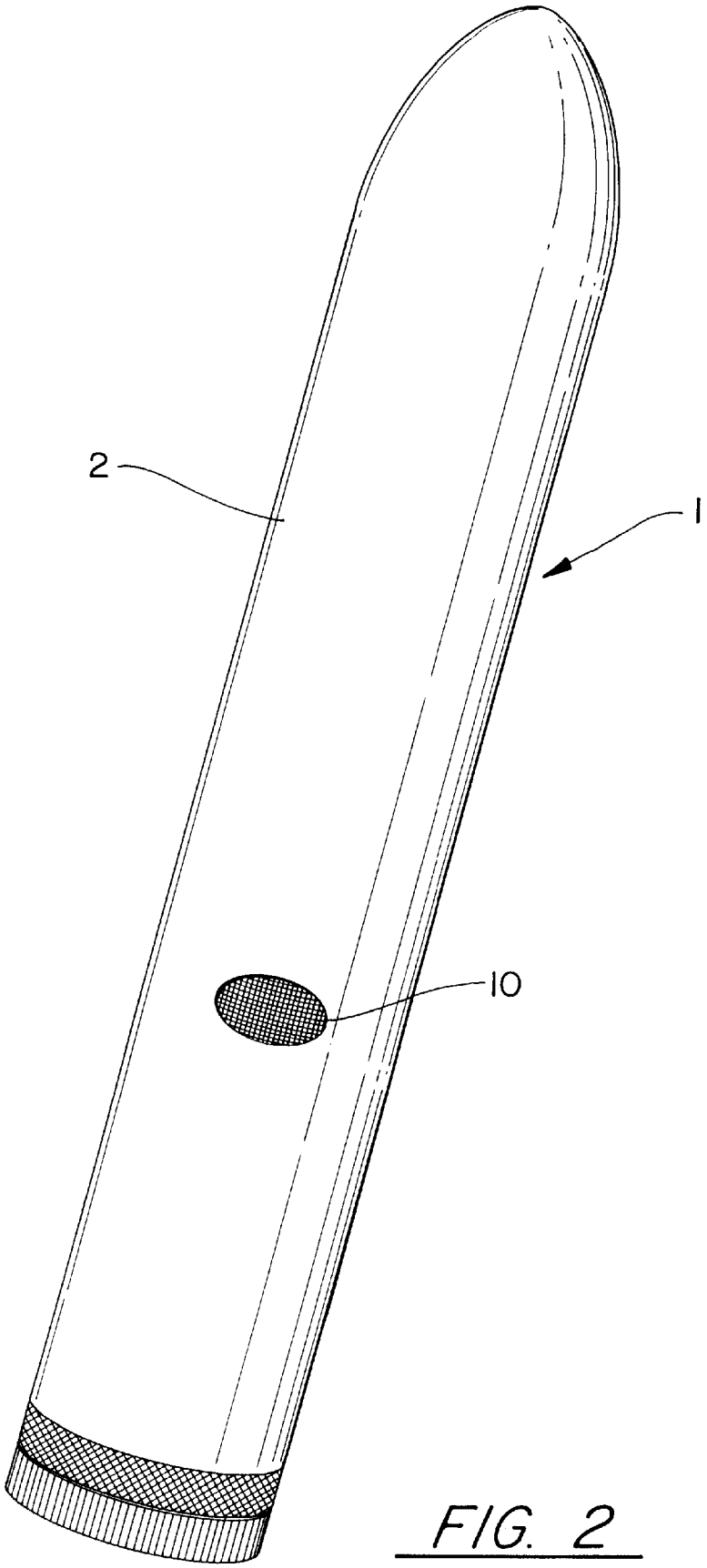
FIG. 2 illustrates a side view of the subject invention showing a speaker disposed in the wall of the housing of the subject massaging device.

As shown in FIG. 2, a sound transmitter 10, e.g., a speaker, is also preferably disposed in the side wall of the housing 2 opposite the microphone 6 and control buttons 7, 8, and 9 shown in FIG. 1. Other configurations for placement of the speaker 10 can also be used. In addition, the volume level of sound emitted from the speaker 10 can be adjustably controlled by a volume control, e.g. a rheostat, as is standard in the art. In a preferred embodiment of the subject invention, the volume control is a rotationally adjustable annular ring at the base of the device or integral with the end cap 5.

Figure 3:
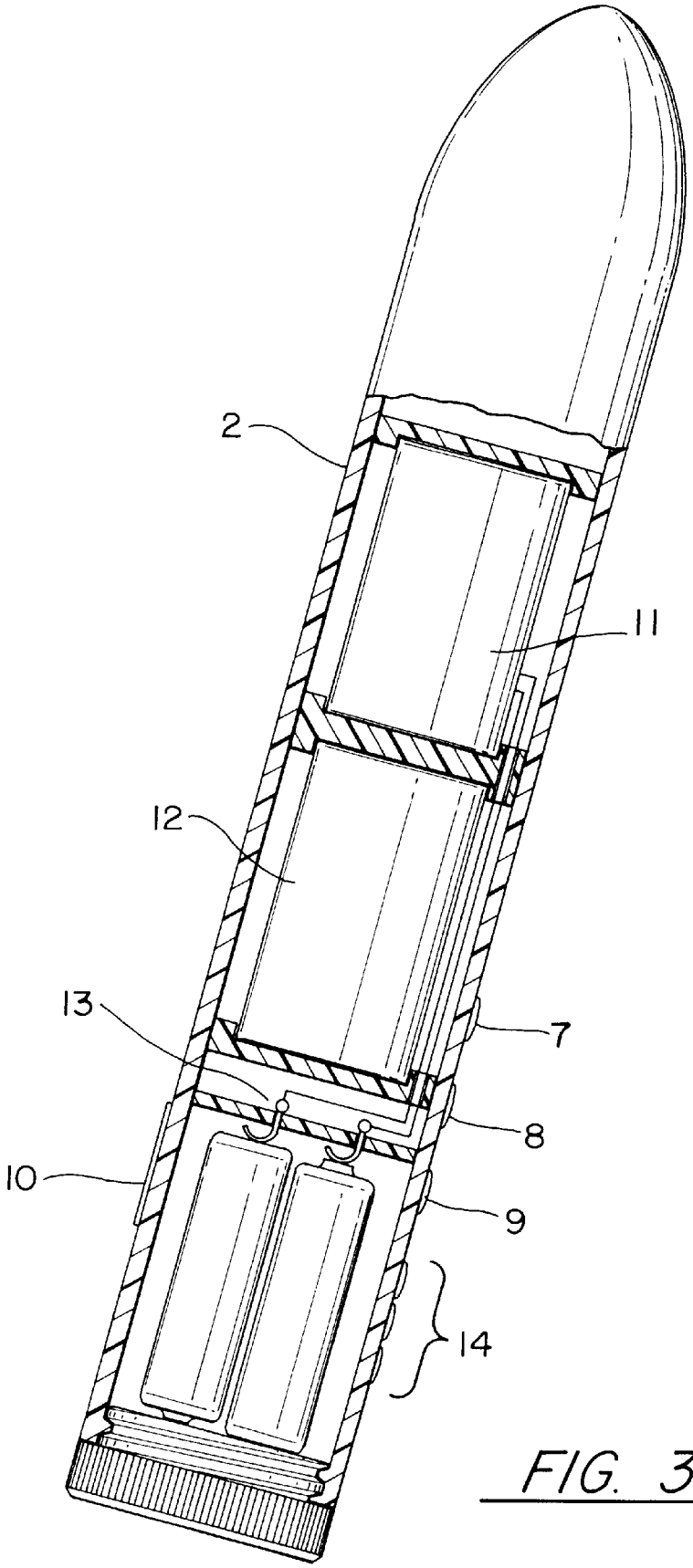
FIG. 3 illustrates an embodiment of the subject invention in cross-sectional view to reveal a vibrating element; circuitry for operation of a microphone, speaker, and control functions; and a power source, disposed within a cavity formed within the hollow housing of the device.

As shown in FIG. 3, the hollow housing 2 of the device forms a cavity in which certain operative mechanisms can be disposed in order to retain convenience features, e.g., the hand-held characteristic of the device. Specifically, the hollow housing 2 can contain the vibrating mechanism 11, and control circuitry 12 for controlling operation of the recording and playback device, the speaker 10, and microphone 6. In addition, the housing 2 can contain a power source 15, e.g., a standard battery or plurality of batteries, for providing power to the vibrating mechanism 11 and control circuitry 12. In one embodiment, as shown in FIG. 3, the cavity inside the hollow housing 2 can include a divider or wall 13 which separates the cavity into a first cavity containing the vibrating mechanism 11 and control circuitry 12, and a second cavity containing the power source 15. Appropriate electrical connections to provide power to or operate the vibrating mechanism 11, and control circuitry 12, and thereby the recording, playback, and speaker mechanisms, are also provided within the housing 2.

The vibrating mechanism 11 can be a standard mechanism commonly used in vibrating devices. Typically, such vibrating mechanisms are adjustable in vibration speed. In a preferred embodiment of the subject invention, the vibrating speed is adjustably controlled by an on/off and variable speed switch connected to or incorporated into the detachable cap. The vibrating mechanism 11 is operated by the power source 15.

The control circuitry 12 preferably includes a solid-state recorder using standard electric circuitry. Such control circuitry 12 can provide the properties of being in small size and light weight which is desirable for disposing the mechanism inside the housing of a hand-held device.

Figure 4:
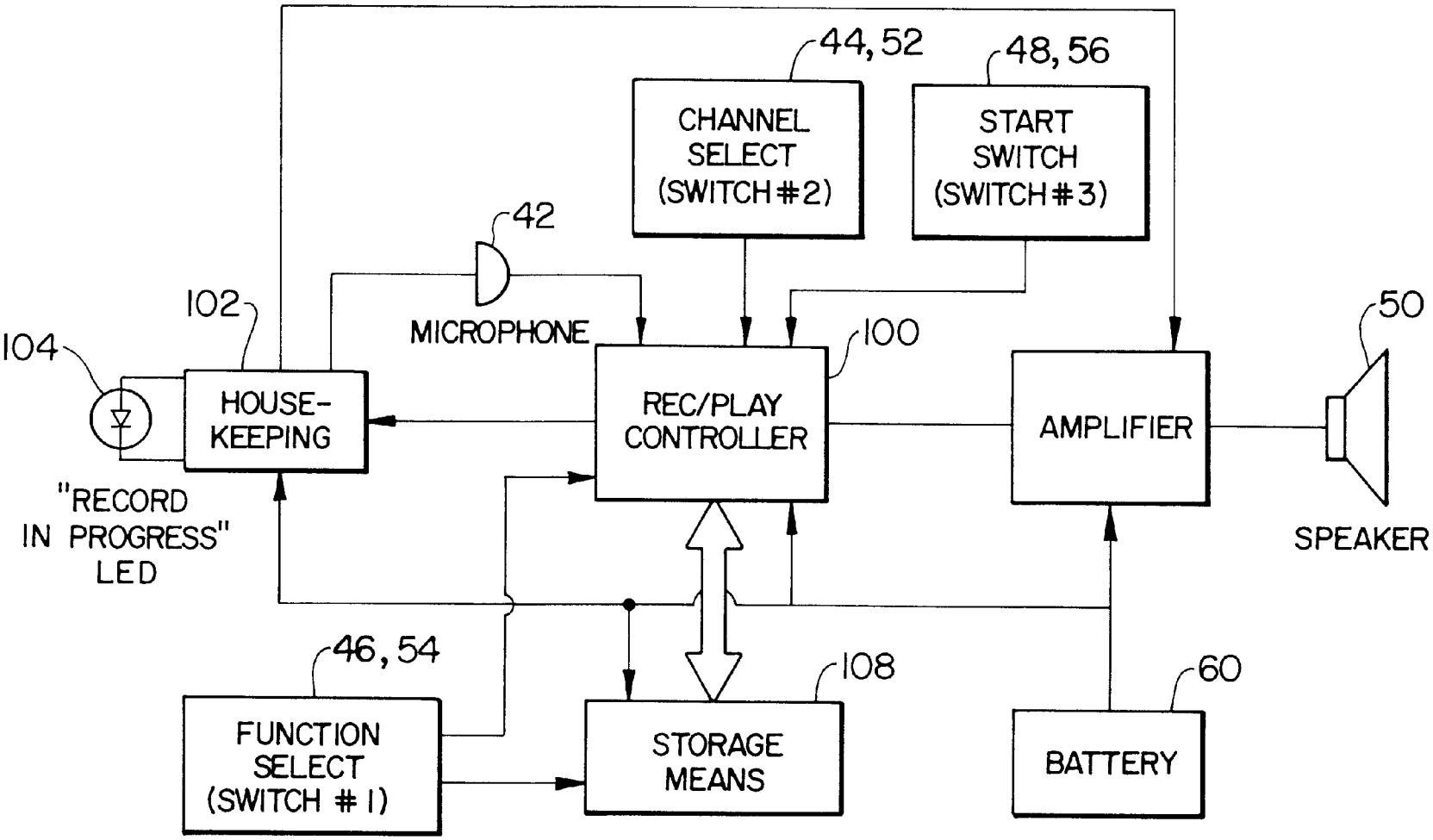
FIG. 4 is a block diagram illustrating the microphone, speaker, and control circuitry of the vibrator/recorder of the subject invention.

FIG. 4 shows exemplary record and playback circuitry 100 mounted on a printed circuit board, typically in the form of a digital audio recorder chipset, e.g., MSM 6388 (voice chip), MSM 6389 (serial register), and MSC 1192 (audio amplifier), available from Oki Semiconductors, Tokyo, Japan. The selector switch 44 and switch actuator 52 feed directly into the voice chip, as do the function selector switch 46 and switch actuator 54 and the stop/start switch 48 and actuator 56. Microphone 42 is connected to the record playback circuitry 100 and can also be connected to auxiliary circuitry 102 which actuates an LED (light emitting diode) 104 during playback or record functions. Such circuitry is known from U.S. Pat. No. 5,313,557.

In use, the vibrator of the subject invention can record personalized messages or sounds, before or during sex, wherein the messages or sounds can be used to reduce tension. For example, the message can be soothing or complimentary comments for enhancing a romantic mood, or can be comedic comments that can release inhibitions or facilitate alteration of an inhibited mood of a person.

The vibrator of the subject invention can further be used to capture spontaneous or intimate thoughts at or near the moment of their conception. These spontaneous or intimate thoughts may be, for example, a note or suggestion to a lover or sex partner, ideas or thoughts regarding sexual fantasies, sexual positions, or other forms of sexual stimulation to be tried at a later time. Such thoughts or ideas that can be uniquely captured at that particular moment in time are limited only by the imagination of the user.

Further, the vibrator of the subject invention can be useful for taking notes on non-sexual subjects or ideas that may occur to the user during sexual interplay. The user can advantageously record the thought or idea without having to locate a pen and paper or other device to record the thought or idea at a time when it may be difficult or undesirable to interrupt the sexual activity.

The advantageous applications of the subject vibrator device, for example, providing for spontaneous recording, result in convenience for the user, who is therefore more likely to use the device which has recording capabilities than a vibrator that lacks such recording capability.

Pre-recorded sounds, messages, or melodies can also be provided by the subject device. Separate controls 14 for actuating the pre-recorded sound effects can include buttons or switches which activate playback of said pre-recorded messages (FIG. 3). The switches used for the device can preferably be piezoelectronic for convenience of use.

It should be understood that the examples and embodiments described herein are for illustrative purposes only and that various modifications or changes in light thereof will be suggested to persons skilled in the art and are to be included within the spirit and purview of this application and the scope of the appended claims.

I claim:

1. A vibrator used for sexual stimulation comprising:

a cylindrical, at least partially hollow housing having a rounded end, a vibrating element for vibrating said housing, and an audio component for selectively recording and emitting sound, wherein said vibrating element and audio component are disposed within said vibrator housing.

2. The vibrator of claim 1 further comprising control means for adjusting rate or speed of vibration of the vibrator element.

3. The vibrator of claim 1, said vibrator further comprising a means for playing a pre-recorded audio signal.

4. The vibrator of claim 3, where said pre-recorded audio signal is controlled by a switch accessible from outside of said housing.

5. The vibrator of claim 1, wherein said vibrator further comprises control buttons accessible from outside said housing for selectively controlling functions of: receiving, recording, erasing, playback, or volume of a sound or an audio signal.

6. A vibrator used for sexual stimulation comprising:

a cylindrical, at least partially hollow housing having a rounded end, a vibrating element for vibrating said housing, and an audio component for recording sound, wherein said vibrating element and audio component are disposed within said vibrator housing, said audio component further comprises:

a microphone for receiving sound and converting said sound into an audio signal, wherein said microphone is in communication with an audio processor;

an audio processor for receiving, storing, manipulating, and playing back said audio signal, said audio processor being in communication with a sound transmitter;

a sound transmitter for emitting sound played back from said audio processor.

7. The vibrator of claim 6, wherein said vibrator further comprises control buttons accessible from outside said housing for selectively controlling functions of: receiving, recording, erasing, playback, or volume of said sound or audio signal.

8. The vibrator of claim 6, wherein said audio processor is a solid-state processor.

9. A vibrator used for sexual stimulation comprising:

a cylindrical, at least partially hollow housing having a rounded end, a vibrating element for vibrating said housing, and an audio component for recording sound, wherein said vibrating element and audio component are disposed within said vibrator housing;

control means for adjusting rate or speed of vibration of the vibrator element, said control means comprises a variable speed switch integral with a detachable cap.

* * * * *